US008210652B2

(12) United States Patent
Atsuta

(10) Patent No.: US 8,210,652 B2
(45) Date of Patent: Jul. 3, 2012

(54) PRINTING HEAD AND METHOD OF MANUFACTURING PRINTING HEAD

(75) Inventor: Tomohisa Atsuta, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 353 days.

(21) Appl. No.: 12/485,257

(22) Filed: Jun. 16, 2009

(65) Prior Publication Data

US 2009/0315947 A1 Dec. 24, 2009

(30) Foreign Application Priority Data

Jun. 20, 2008 (JP) ..... 2008-161810

(51) Int. Cl.
*B41J 2/14* (2006.01)
*B41J 2/16* (2006.01)

(52) U.S. Cl. ..... 347/50

(58) Field of Classification Search ..... 347/50
See application file for complete search history.

(56) References Cited

U.S. PATENT DOCUMENTS 5,058,798 A * 10/1991 Yamazaki et al. ..... 228/110.1
6,126,271 A * 10/2000 Terui ..... 347/50
6,481,819 B2 * 11/2002 Kaneko et al. ..... 347/15
7,115,975 B2 10/2006 Mori
2006/0139410 A1 * 6/2006 Kawamura et al. ..... 347/58

FOREIGN PATENT DOCUMENTS

JP 2005-101546 4/2005

* cited by examiner

*Primary Examiner* — Matthew Luu
*Assistant Examiner* — Renee I Wilson
(74) *Attorney, Agent, or Firm* — Fitzpatrick, Cella, Harper & Scinto

(57) ABSTRACT

A printing head is provided by which, even when the stress is caused by a connecting section between a printing element substrate-side electrode terminal and a lead when the connecting section is heated and is subsequently cooled, the connecting section can be suppressed from having a deteriorated reliability. The printing head is structured so that the electrode pads are connected to the inner leads via stud bumps. The connection between the electrode pad and the stud bump is performed by applying ultrasonic oscillation to the connecting part in the first direction while the electrode pad is having a contact with the stud bump. The connection between the inner lead and the stud bump is performed by applying ultrasonic oscillation to the connecting part in the second direction intersecting with the first direction while the inner lead is having a contact with the stud bump.

5 Claims, 8 Drawing Sheets

| | CONVENTIONAL METHOD | THIS EMBODIMENT |
|---|---|---|
| GENERATION RATE OF CRATERING | 56.5% | 28.9% |

FIG.3

PRINTING HEAD AND METHOD OF MANUFACTURING PRINTING HEAD

BACKGROUND OF THE INVENTION

1. Field of the Invention

The present invention relates to a printing head and the manufacture method thereof. In particular, the invention relates to a method of manufacturing a printing head connecting an electrode terminal of a printing element substrate to the corresponding lead, and a printing head manufactured by the method.

2. Description of the Related Art

In recent years, an ink jet printing apparatus for ejecting ink droplets from a printing head to perform a printing operation has been increasingly diffused. Such an ink jet printing apparatus is advantageous in that the miniaturization is easy and a color printing can be performed relatively easy for example.

Among methods of manufacturing a printing head used for an ink jet printing apparatus, a method is known in which an electrode pad as an electrode terminal is electrically connected via a stud bump to a flexible film wiring substrate. According to this method, via the bump provided on the electrode pad, the electrode pad is electrically connected to a wiring formed on the flexible film wiring substrate such as TAB or FPC.

FIG. 4A and FIG. 4B illustrate an example of an ink jet printing head using such a flexible film wiring substrate. FIG. 4A is a plan view of the printing head and FIG. 4B is a cross-sectional view taken along the line B-B of FIG. 4A.

In FIG. 4A and FIG. 4B, the reference numeral 101 denotes a printing element substrate made of silicon or the like. A printing element substrate 101 is cut out from a wafer by dicing. The reference numeral 102 denotes a flexible film wiring substrate having an inner lead 105. The inner lead 105 functions as a lead in an electric wiring pattern in the flexible film wiring substrate 102. The printing element substrate 101 and the flexible film wiring substrate 102 are positioned on a supporting member 110 with a high accuracy. The flexible film wiring substrate 102 includes a rectangular device hole 103 for fixing the printing element substrate 101. On the upper face of the flexible film wiring substrate 102, a flat plate-like base film 104 is formed that consists of insulating resin such as polyimide. The inner lead 105 is obtained by bonding the lower face of the base film 104 to a metal foil consisting of conductive material such as a copper foil to subsequently pattern the metal foil to have a desired shape by a photolithography technique. The surface of the inner lead 105 after the patterning is subjected to plating processing by gold or tin or solder or the like. A region of the metal face of the inner lead 105 in which the surface should not be exposed is covered and protected by resist layer 108 or the like. At the same time, a wiring electrode and an electrode pad connected to a main body or the like are also formed.

The inner lead 105 is formed to extend from the flexible film wiring substrate 102 to the opening of the device hole 103. The surface of the printing element substrate 101 has thereon a plurality of electrode pads 106. The electrode pads 106 are electrically connected, via the stud bumps 107, to the tip ends of the inner leads 105 extending to and existing into the opening of the device hole 103.

The electrode pad 106 has thereon the stud bump 107 formed by metal in advance and is connected to the stud bump 107. The connection among the respective terminals by the stud bumps 107 is carried out by fusing the connecting sections of the stud bump 107 to subsequently solidifying the connecting sections while the stud bumps 107 being connected to the respective terminals to achieve the integration therebetween.

The stud bump is arranged on the electrode pad of a printing element substrate when the printing element substrate is in a wafer status and the stud bump is connected to the electrode pad. When the stud bump is arranged, electricity is discharged to a gold wire having a diameter of several tens of microns to form the tip end of the gold wire to have a ball-like shape. Then, the ball-like-shaped tip end of the gold wire is separated from the gold wire to be placed on the electrode pad by receiving the ultrasonic oscillation via a hump tool while the stud bump is being placed on the electrode pad. As described above, there is a method called a single point bonding method by which gold balls are formed one by one on an electrode pad. There is another method for forming a stud bump on an electrode pad called a gang bonding method by which gold plating is used to simultaneously form bumps on all electrode pads of a printing element substrate. When these methods are used to provide the stud bump 107 on the electrode pad, the inner lead 105 to be connected is positioned at a position corresponding to the stud bump 107. Then, during this status, a flexible film wiring substrate is adhered and fixed to the supporting member 110. Thereafter, a bonding tool is used from above the inner lead 105 to join the inner lead 105 to the stud bump 107. As a result, the inner lead 105 is electrically connected to the electrode pad 106. The connection method as described above is called an Inner Lead Bonding (ILB).

With regard to the ILB method, the two methods of the single point bonding method and the gang bonding method are well-known. In any of these ILB methods, at least any of the inner lead 105 and the stud bump 107 is heated at a high temperature and is connected to each other while being fused. When the connection therebetween is performed by the gang bonding method using the inner lead 105 having a gold-plated surface and the stud bump 107 formed by a gold pole, the bonding tool must be heated to a temperature of about 500 degrees C. Furthermore, when the connection therebetween is performed by the single point bonding method as described above, the bonding tool must be heated to a temperature of about 200 degrees C.

When the stud bump and the inner lead once heated to have a high temperature and are subsequently cooled to have an ordinary temperature, the connecting part that has once expanded by the high temperature is cooled and shrinks. When the members to be connected are compared to each other with regard to thermal expansion coefficient, the base film 104 mainly composed of insulating organic resin and the inner lead 105 mainly composed of copper have thermal expansion coefficients that are significantly higher than the thermal expansion coefficient of the printing element substrate 101 composed of silicon or the like. Thus, when the stud bump 107 and the inner lead 105 formed on the electrode pad 106 of the printing element substrate 101 are connected to each other while being heated and then are cooled until an ordinary temperature is reached, there is a risk where a stress may be caused after the cooling and the stress may act on the respective connecting parts.

When this stress exceeds the joint strength between the electrode pad 106 and the stud bump 107 or the joint strength between the stud bump 107 and the inner lead 105, the joint part may be peeled. Specifically, a risk may be caused where this stress may deteriorate the reliability of the connecting part between the inner lead 105 and the electrode pad 106.

In the case of the mounting in an apparatus requiring a high position accuracy such as an ink jet printing head in particular, the printing element substrate 101 must be fixed to the supporting member 110 accurately. Thus, when the residual stress as described above remains in the connecting section, there is a risk where the position accuracies of the respective members may not be maintained to be high.

In order to solve the disadvantage as described above, Japanese Patent Laid-Open No. 2005-101546 discloses a printing head as shown in FIGS. 5A to 5C in which an inner lead is formed to have an easily-deformable shape. By forming the inner lead to have an easily-deformable shape, even when a stress is generated, the inner lead elastically deforms to absorb the stress. This consequently can suppress this stress from causing the deteriorated reliability of the connecting section. This also can consequently suppress the stress from causing the deteriorated position accuracies of the members.

In the case of the printing head disclosed in Japanese Patent Laid-Open No. 2005-101546, however, in order to provide the deformable-shape, the width of the inner lead is partially reduced to reduce the cross-sectional area of a region other than the part at which the inner lead is joined to the electrode pad. Such a reduction of the cross-sectional area of a region other than the part at which the inner lead is joined to the stud bump by the reduced width of the inner lead causes the part to have a higher electric resistance. Due to this reason, when the printing operation is performed, this part is heated whenever power is distributed to the printing element in the ink jet printing head in order to drive the printing element. This may cause, when the printing operation is performed for a long time, excessive heat in the inner lead. Also, due to the repeated deformation of the heated inner lead, there is a possibility that the durability of the inner lead is deteriorated. As described above, even when the stress in the electric connecting part is absorbed by the deformation of the inner lead, the repeated deformation of the inner lead itself may cause a risk of a deteriorated durability of the inner lead. Furthermore, the deformable and complicated shape of the inner lead also may cause a risk where the inner lead may be unintentionally deformed in a step of mounting the flexible film wiring substrate. Furthermore, the complicated shape of the inner lead also may cause a risk of an increased cost for manufacturing the flexible film wiring substrate.

Furthermore, more ink jet printing apparatuses have been miniaturized in recent years. In accordance with this, printing element substrates have been miniaturized and highly-integrated. This proportionally reduces the size of the electrode pad and the pitch between electrode pads, thus proportionally reducing the width of an inner lead. Therefore, there is a risk of further-increased heat generated in the inner lead during power distribution.

On the other hand, it is known that the decreased reliability of the electrode pad is related to not only the difference in thermal expansion between the inner lead and the flexible film wiring substrate but also the direction of the ultrasonic oscillation applied to the connecting section.

FIG. 6A is a plan view illustrating a wafer in which a plurality of printing element substrates are arranged, before a stud bump is placed and connected to a printing element substrate. FIG. 6B is a plan view illustrating electrode pads formed on the printing element substrate and stud bumps formed on the electrode pads. FIG. 6C is a cross-sectional view taken along the line VIC-VIC of the stud bumps placed on the printing element substrate. FIG. 7A is a plan view illustrating the printing element substrate in which the direction of ultrasonic oscillation is shown. FIG. 7B is a cross-sectional view illustrating the stud bumps 107 taken along the line VIIB-VIIB in which the upper parts of the stud bumps 107 are smoothed by the ultrasonic oscillation. FIG. 8 is a plan view illustrating a joint part at which the stud bump is joined to the inner lead by ILB.

As shown in FIG. 6B, by the single point method, the stud bumps 107 are formed on and are joined to the electrode pads 106 of the printing element substrate 101. During this process, the ultrasonic oscillation is applied to the stud bumps 107 in the longitudinal direction of the printing element substrate 101. Thereafter, leveling is performed in order to smooth the uppermost parts of the stud bumps 107. During this process, as in the step of arranging the stud bumps on the inner leads, ultrasonic oscillation is also applied to the stud bumps 107 in the longitudinal direction of the printing element substrate 101 as shown in FIG. 7A. Thereafter, the inner leads 105 and the stud bumps 107 are joined by ILB. During the process of joining the stud bumps 107 and the inner leads 105 by ILB, ultrasonic oscillation is applied to the stud bumps 107 in the longitudinal direction of the printing element substrate 101 as shown in FIG. 8.

Through these steps, the printing element substrate 101 is electrically connected to the flexible film wiring substrate 102 by ultrasonic oscillation. This ultrasonic oscillation performed for the electrical connection is generally performed only in the longitudinal direction of the printing element substrate 101 in all steps. Thus, there is a possibility where the electrode pads of the printing element substrate 101 may receive a relatively-high stress due to the stress caused by the cooling after the joint by the ultrasonic oscillation combined with the above-described stress in the connecting section due to the difference in thermal expansion. Due to the reasons, even when the inner lead has an easily-deformable shape for absorbing the stress left in the cooling process, there is a risk where the total stress may exceed the stress that can be absorbed by the deformation of the shape of the inner lead, thereby deteriorating the reliability of the printing head.

SUMMARY OF THE INVENTION

The present invention has been made in view of the above disadvantages. It is an objective of the invention to provide a printing head that can suppress the reliability of the connecting section even when a stress is caused by the heating and the subsequent cooling of the connecting section between the electrode terminal of the printing element substrate and the lead.

According to a first aspect of the present invention, there is provided a printing head, comprising: a printing element for applying energy to liquid in order to eject the liquid through an ejection port; an electrode terminal being formed at an end of a wiring extending from the printing element for transmitting electric energy to the printing element; and a lead for transmitting a driving signal for driving the printing element, the lead being arranged in a position corresponding to the electrode terminal, wherein: the electrode terminal is connected to the lead via a bump, the connection between the electrode terminal and the bump is performed by applying ultrasonic oscillation to a connecting part between the electrode terminal and the bump in a first direction while the electrode terminal is having a contact with the bump, and the connection between the lead and the bump is performed by applying ultrasonic oscillation to a connecting part between the lead and the bump in a second direction intersecting with the first direction while the lead is having a contact with the bump.

According to a second aspect of the present invention, there is provided a method of manufacturing a printing head, the printing head including: a printing element for applying energy to liquid in order to eject the liquid through an ejection port; an electrode terminal being formed at an end of a wiring extending from the printing element for transmitting electric energy to the printing element; and a lead for transmitting a driving signal for driving the printing element, the lead being arranged in a position corresponding to the electrode terminal, wherein: the electrode terminal is connected to the lead via a bump, the method of manufacturing a printing head includes: an electrode terminal connection step for applying ultrasonic oscillation to a connecting part between the electrode terminal and the bump in a first direction while the electrode terminal is having a contact with the bump to connect the electrode terminal to the bump; and a lead connection step for applying ultrasonic oscillation to a connecting part between the lead and the bump in a second direction intersecting with the first direction to connect the lead to the bump while the lead is having a contact with the bump.

According to the present invention, the reliability of the connecting section between the electrode terminal of the printing element substrate and the lead is improved. Thus, a printing head having improved reliability can be provided.

Further features of the present invention will become apparent from the following description of exemplary embodiments (with reference to the attached drawings).

BRIEF DESCRIPTION OF THE DRAWINGS

FIG. 3 is a table illustrating the comparison regarding the generation rate of cratering in a pull test between the connecting part of the printing head manufactured by electrically connecting the printing element substrate of FIGS. 2A to 2C to the flexible wiring film and a conventional connection method;

DESCRIPTION OF THE EMBODIMENTS

The following section will describe embodiments for carrying out the present invention with reference to the attached drawings.

Figure 1:
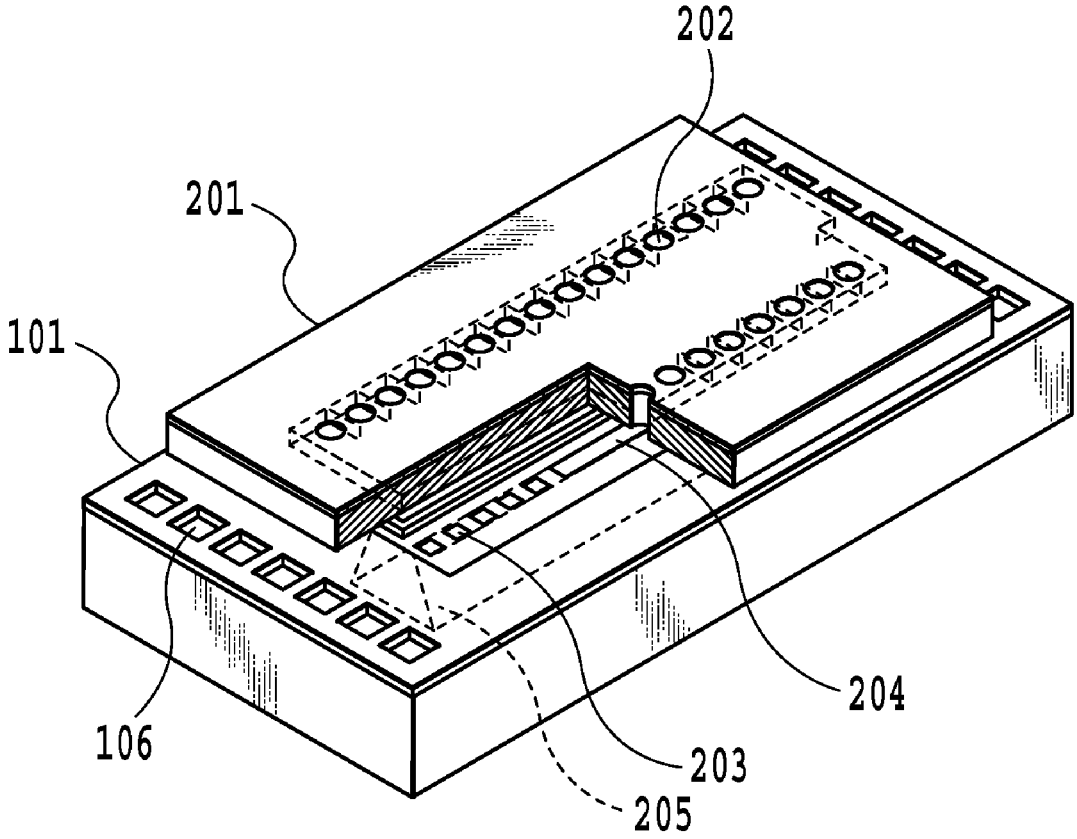
FIG. 1 is a partially broken perspective view illustrating a printing element substrate and an orifice plate used in a printing head according to one embodiment of the present invention.

The printing head of this embodiment is used for an ink jet printing apparatus and ejects liquid such as ink to a printing medium. The configuration of this printing head will be described with reference to FIG. 1. This printing head includes: the printing element substrate 101 having a printing element 203 for applying energy to ink in order to eject ink stored in a liquid room; and an orifice plate 201 joined to this printing element substrate 101. The orifice plate 201 has a plurality of ejection port 202 for ejecting liquid droplets of ink. By joining the orifice plate 201 to the printing element substrate 101, a liquid room 204 and an ink flow path communicating with the liquid room 204 for example are formed. The liquid room 204 communicates with the ejection port 202 and can function as an energy-acting room that can store therein ink. Among the walls forming the interior space of the liquid room 204, the walls forming the interior of the printing element substrate 101 include therein the printing element 203. When the printing element 203 is driven, bubbles are generated in the liquid room 204 to generate a foam pressure that causes the ink stored in the liquid room 204 to be ejected through the ejection ports 202. The printing element substrate 101 also includes an ink supply port 205 that extends from the main face having a contact with the orifice plate 201 to the opposite back face so as to penetrate the printing element substrate 101.

Figure 2A:
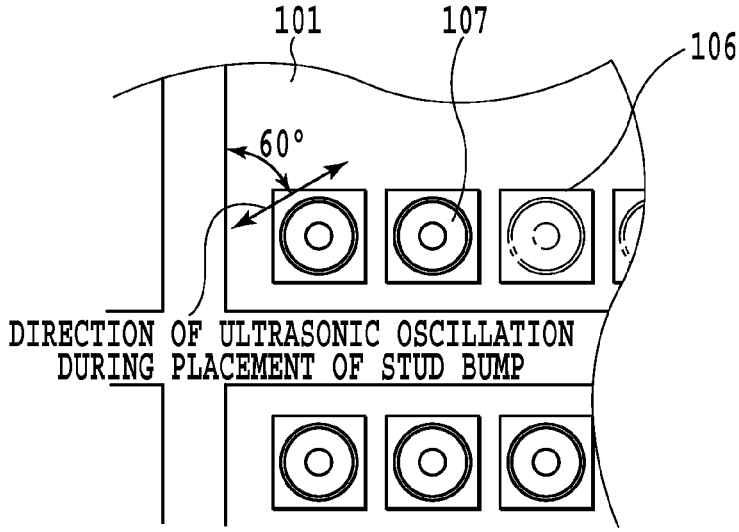
FIGS. 2A to 2C illustrate steps of electrically connecting the printing element substrate of FIG. 1 to a flexible wiring film for the manufacture of the printing head.
Figure 2B:
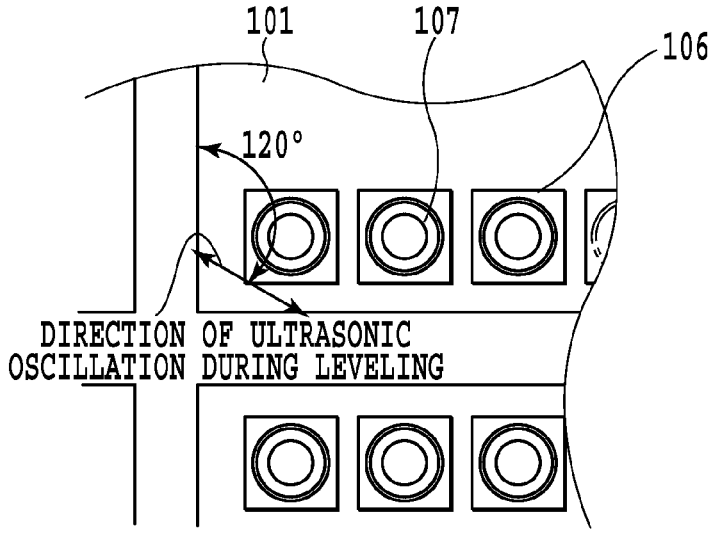
Figure 2C:
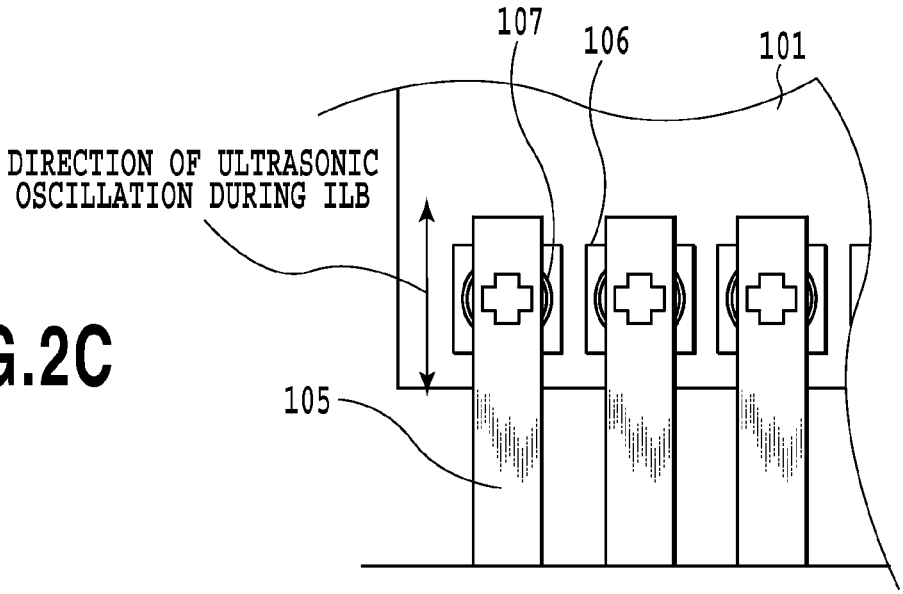
Figure 4A:
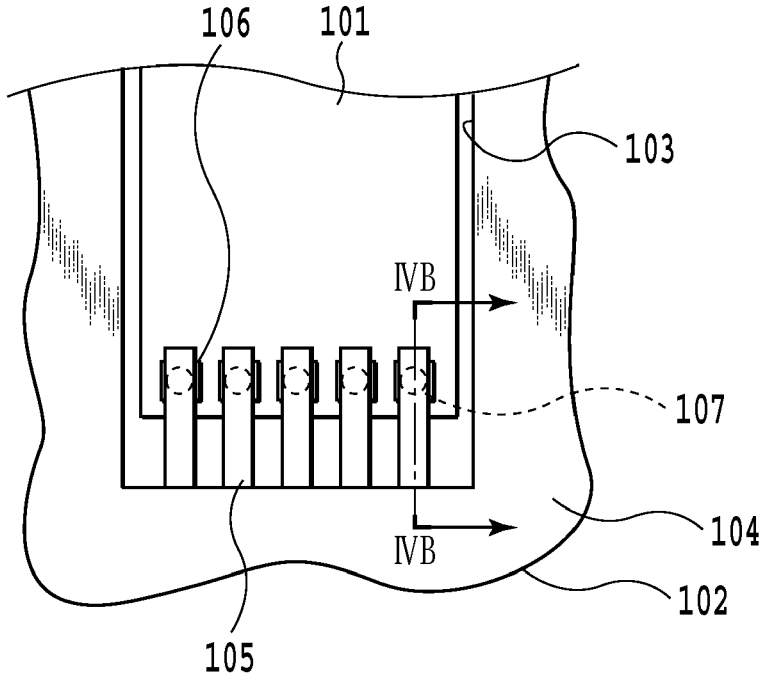
FIG. 4A is a plan view illustrating a printing head in which the printing element substrate is electrically connected by a conventional method to the flexible wiring film.
Figure 4B:
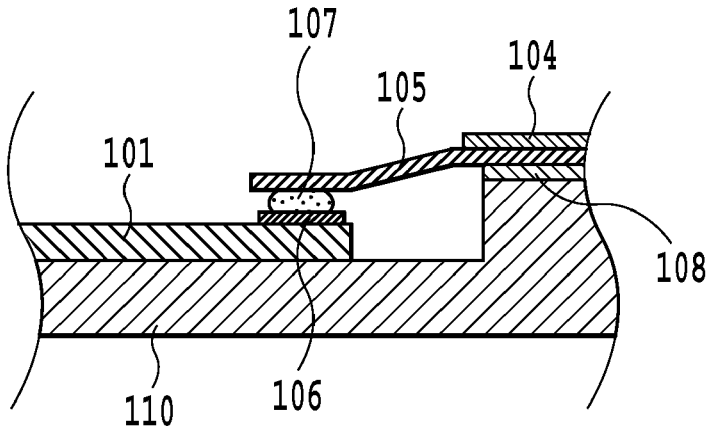
FIG. 4B is a cross-sectional view taken along the line IVB-IVB of FIG. 4A.
Figure 5A:
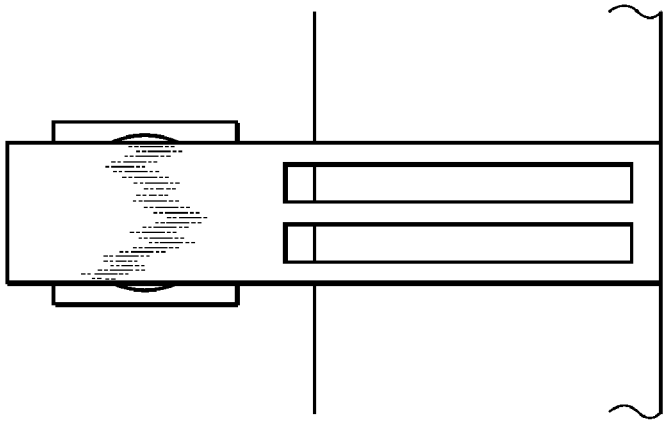
FIGS. 5A to 5C are plan views illustrating the connecting part in which another conventional mode is used to electrically connect the printing element substrate to the flexible wiring film.
Figure 5B:
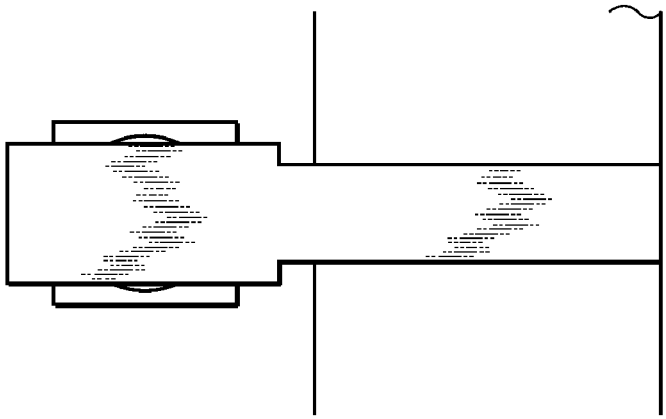
Figure 5C:
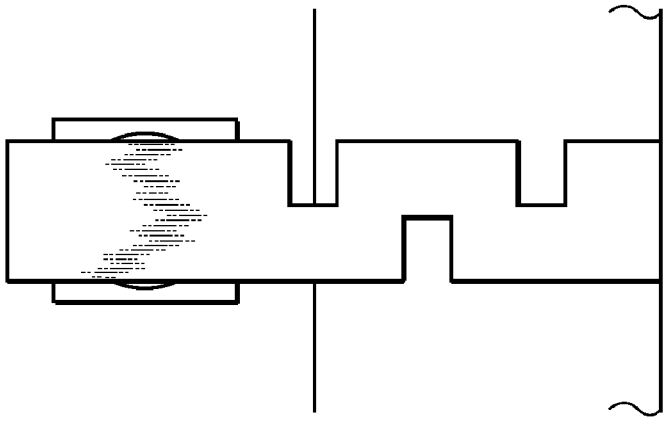
Figure 6A:
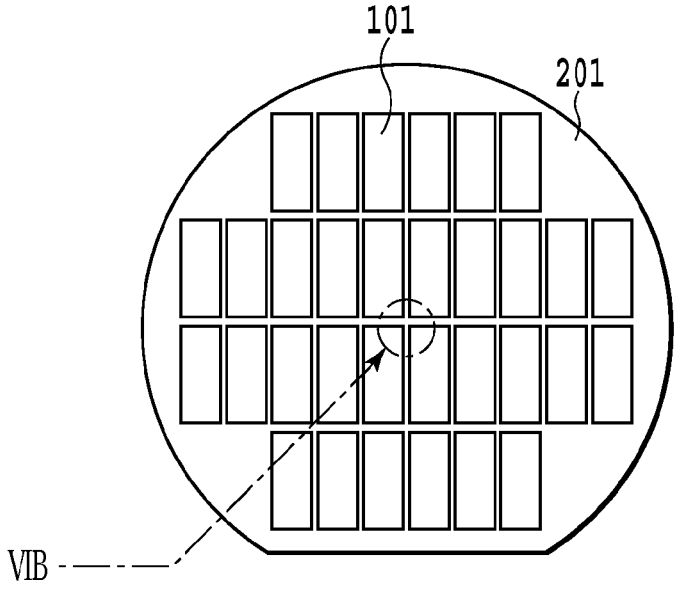
FIGS. 6A to 6C illustrate steps of using a conventional method to place stud bumps on the printing element substrate.
Figure 6B:
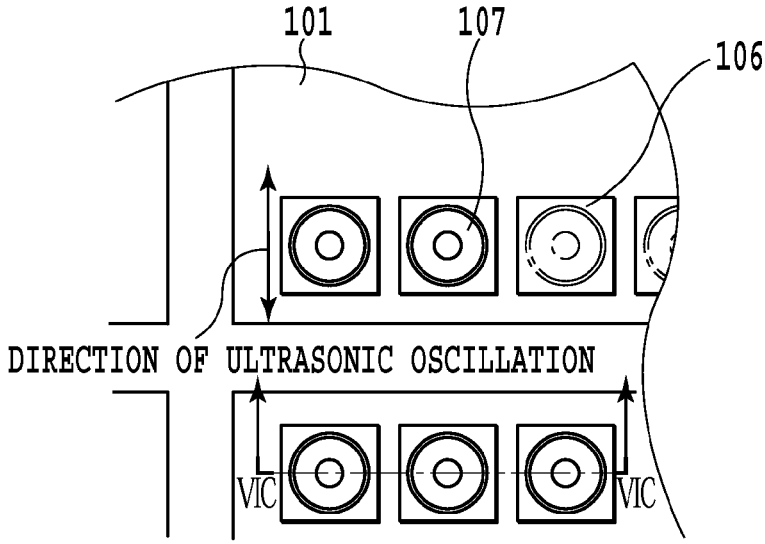
Figure 6C:
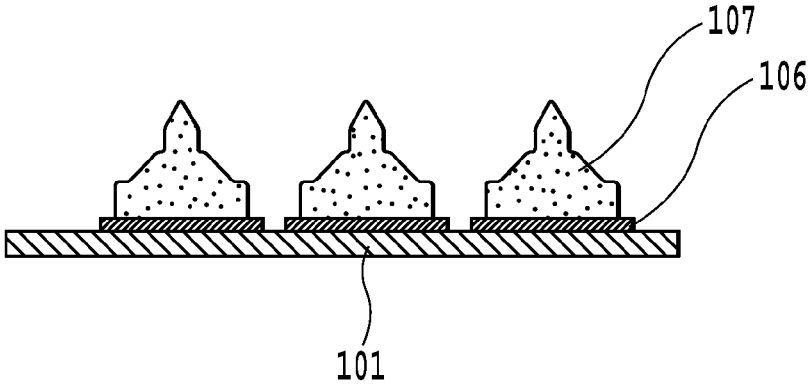
Figure 7A:
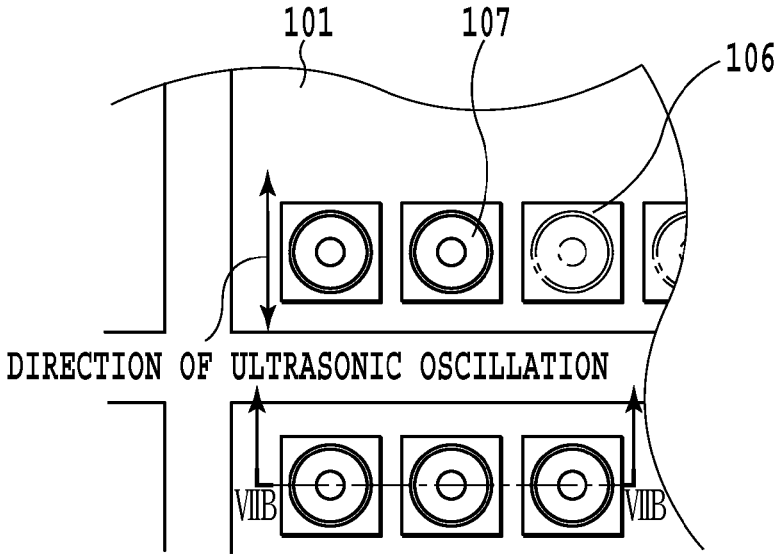
FIG. 7A is a plan view illustrating the direction of ultrasonic oscillation applied to the connecting part when a conventional method is used to connect electrode pads to stud bumps.
Figure 7B:
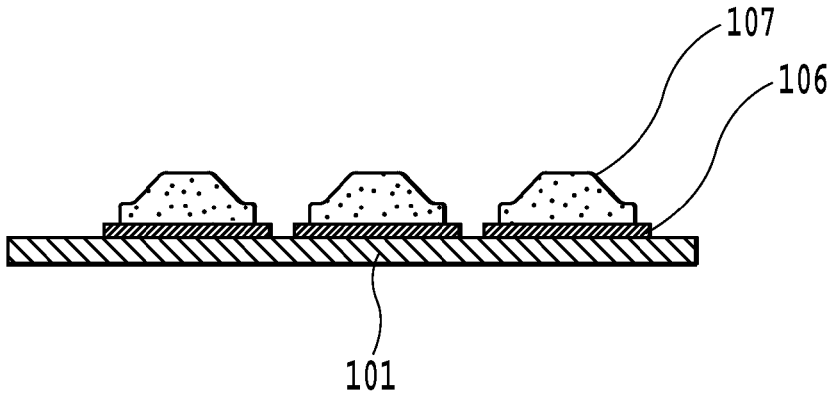
FIG. 7B is a cross-sectional view of the joint part taken along the line VIIB-VIIB in which the upper parts of the stud bumps are smoothed.
Figure 8:
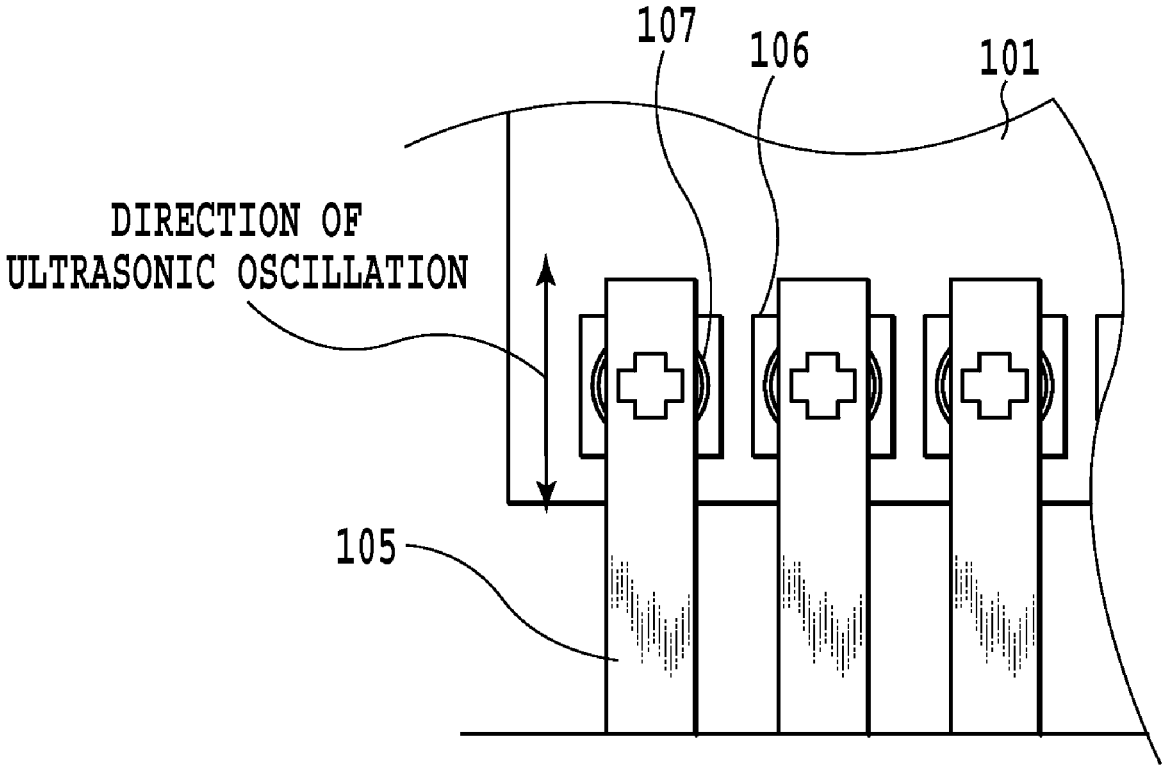
FIG. 8 is a plan view illustrating the direction of ultrasonic oscillation applied to the connecting part when the conventional method is used to connect the inner leads to the stud bumps.

As shown in FIGS. 2A to 2C, the printing element substrate 101 includes an electrode pad 106 as an electrode terminal for transmitting the electric energy for ejecting ink. The electrode pad 106 is formed at an end of the wiring extending from the printing element 203. At a position corresponding to the electrode pad 106, the inner lead 105 as a lead is formed. The inner lead 105 is provided in order to transmit a driving signal for driving the printing element 203. In this embodiment, the electrode pad 106 is connected to the inner lead 105 via the stud bump 107 as a bump.

The following section will describe the manufacture method of the printing head of this embodiment with reference to FIGS. 2A to 2C. FIG. 2A is a plan view illustrating the printing element substrate 101 of this embodiment in which the stud bump 107 is connected to the electrode pad 106. FIG. 2B is a plan view illustrating the stud bump 107 and the printing element substrate 101 after the leveling for smoothing the uppermost parts of the stud bumps 107 is performed. FIG. 2C is a plan view illustrating a joint part at which the electrode pad 106 is joined to the inner lead 105 when the stud bump 107 is joined to the inner lead 105 by ILB.

In this embodiment, the electrode pad 106 is firstly connected to the stud bump 107 while a plurality of the printing element substrates 101 are being formed in a wafer (electrode terminal connection step). When the electrode terminal connection step is performed, the electrode pads 106 are already formed in the wafer. On the electrode pads 106 of the printing element substrates 101 patterned in the wafer, the stud bumps 107 are formed by the single point method. Then, the electrode pads 106 are connected to the stud bumps 107. During this connection, in all regions in the wafer, the ultrasonic oscillation by vibration direction at an angle of 60 degrees to the longitudinal direction of the printing element substrate 101 is applied to the connecting section as shown by the arrow of FIG. 2A. As described above, in the electrode pad connection step as the electrode terminal connection step, the ultrasonic oscillation is applied to the connecting part in the first direction while the electrode pad 106 is having a contact with the stud bump 107 to connect the electrode pad 106 to the stud bump 107.

In this embodiment, the connecting between the stud bumps 107 and the electrode pads 106 in the electrode pad connection step is performed in the stage at which the electrode pads 106 are being formed in the wafer. Then, all connecting parts in the wafer at which the electrode pads 106 are connected to the stud bumps 107 receive the ultrasonic oscillation in the first direction. In this embodiment, the electrode pads 106 are simultaneously connected to the stud bumps 107 in all of the printing element substrates 101 in the wafer as described above. Thus, the manufacture steps of the printing head can be reduced.

Next, a bump formation step (which will be described later) is performed in this embodiment. FIG. 2B is a plan view illustrating the connecting sections at which the stud bumps 107 are connected to the electrode pads 106 during the bump formation step.

Thereafter, the printing element substrate 101 in which the stud bumps 107 are formed is diced to individual pieces. Then, the cut printing element substrates 101 are positioned to supporting members with a high accuracy.

Next, in an inner lead connection step as a lead connection step, while the inner leads 105 having a contact with the stud bumps 107, the connecting parts receive the ultrasonic oscillation in the second direction to connect the inner leads 105 to the stud bumps 107. The second direction is a direction intersecting with the first direction. Then, as shown in FIG. 2C, the inner lead 105 is joined to the stud bump 107 by ILB with using the bonding tool applied from the above of the inner lead 105. During the ILB, the ultrasonic oscillation is applied in the longitudinal direction of the printing element substrate 101 as shown by the arrow of FIG. 2C. During this process, the flexible film wiring substrate 102 is joined to the printing element substrate 101 so that the center in the width direction of the inner lead 105 in the flexible film wiring substrate 102 is superposed on the center of the electrode pad of the printing element substrate 101.

The following section will describe the bump connection step between the electrode terminal connection step and the inner lead connection step. In this embodiment, after the stud bumps 107 are connected to the electrode pads 106 in the electrode terminal connection step, the ultrasonic oscillation and a load are applied to the stud bump 107 for leveling in order to smooth the uppermost parts of the stud bumps 107. As described above, the stud bumps 107 are formed to have a predetermined shape while receiving the ultrasonic oscillation. Then, the ultrasonic oscillation for forming the stud bumps 107 to have a predetermined shape is applied in the third direction intersecting with the first direction and the second direction. During this process, the ultrasonic oscillation is applied in all regions in the wafer in the direction shown by the arrow of FIG. 2B. Specifically, in this embodiment, the ultrasonic oscillation is applied in the direction inclined by 120 degrees to the longitudinal direction of the printing element substrate 101. As a result, in all regions in the wafer, the direction of the ultrasonic oscillation for connecting the stud bumps 107 to the electrode pads 106 intersects with the direction of the ultrasonic oscillation for the leveling process. As described above, in the bump formation step after the electrode terminal connection step, the stud bumps 107 connected to the electrode pads 106 receive the ultrasonic oscillation applied in the third direction intersecting with the first direction and the second direction to form the stud bumps 107 to have a predetermined shape.

In this embodiment, with regards to a direction along the longitudinal direction of the printing element substrate 101, the first direction is a direction inclined by 60 degrees from the referential longitudinal direction of the printing element substrate 101 (FIG. 2A). The third direction is a direction further inclined by 60 degrees from the first direction and 120 degrees from the referential direction (FIG. 2B). The second direction is a direction further inclined by 60 degrees from the third direction and parallel to the referential direction (FIG. 2C).

As described above, in this embodiment, the stud bumps 107 and the connecting sections receive the three ultrasonic oscillations composed of the connection between the stud bumps 107 and the electrode pads 106, the leveling of the stud bumps 107, and the ILB. These three ultrasonic oscillations are applied in directions intersecting with one another with an angle of 60 degrees, respectively. Thus, the directions along which stress is caused do not concentrate and intersect with one another. Thus, the directions of the stresses caused in the respective steps are dispersed. Thus, the concentration of stress is suppressed and the reliability of the printing head is improved.

The printing head of this embodiment is manufactured, as described above, by connecting the electrode pads 106 of the printing element substrate 101 to the inner leads 105 of the flexible film wiring substrate 102. Thus, the printing head of this embodiment is structured so that the electrode pads 106 are connected to the inner leads 105 via the stud bumps 107. The connection between the electrode pad 106 and the stud bump 107 is performed by applying the ultrasonic oscillation to the connecting part in the first direction while the electrode pad 106 is having a contact with the stud bump 107. The connection between the inner lead 105 and the stud bump 107 is performed by applying the ultrasonic oscillation to the connecting part in the second direction intersecting with the first direction while the inner lead 105 is having a contact with the stud bump 107.

When the printing head is manufactured, the ultrasonic oscillation is applied to the stud bump 107 to form the stud bump 107 to have a predetermined shape. The ultrasonic oscillation applied in order to form the stud bump 107 to have a predetermined shape is in the third direction intersecting with the first direction and the second direction.

FIG. 3 shows the result of the comparison obtained by performing ILB by applying the ultrasonic oscillation with an ultrasonic output having a higher value than that of a generally-used ultrasonic output to subsequently pull up the inner lead to confirm the generation rate of cratering. The term "cratering" means herein a breakage caused in a part at which an electrode pad is electrically connected to an inner lead. This test is performed by gradually increasing the force for pulling up the inner lead from zero until the electrical connection between the electrode pad and the inner lead is blocked. When the connecting part among the electrode pad, the stud bump, and the inner lead is broken, this is assumed as generating of a cratering. When a part other than the connecting part thereamong is broken (e.g., when a part other than the connecting part in the inner lead for example is broken), this is not assumed as generating of a cratering. FIG. 3 shows a table illustrating the comparison regarding the generation rate of cratering by the pull test between the electrical connection by this embodiment between the electrode pad and the inner lead and the connection by a conventional method.

When ILB is performed with an ultrasonic output higher than the general one, it is considered that a higher stress is left in the connecting section than in a case where a general ultrasonic oscillation is applied thereto. However, by changing every direction of the ultrasonic oscillation as in this embodiment, directions in which stress is caused are dispersed. Thus, the printing head of this embodiment can suppress, even when ILB with an ultrasonic output higher than in the general case is performed, generating rate of the cratering to about 50% of generating rate of the cratering of the printing head by the conventional method.

The printing head of the present invention can be used in apparatuses (e.g., a printer, copier, a facsimile machine having a communication system, a word processor having a printing section) and complex industrial printing apparatuses combined with various processing apparatuses. By using this printing head, a printing operation can be performed on various printing media such as paper, thread, fibers, cloth, leather, metal, plastic, glass, wood, and ceramics. The term "printing" used herein means not only an operation to apply an image having a meaning of characters or graphics to a printing medium but also an operation to apply an image having no meaning such as a pattern.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-161810, filed Jun. 20, 2008, which is hereby incorporated by reference herein in its entirety.

What is claimed is:

1. A printing head, comprising:

a printing element for applying energy to liquid in order to eject the liquid through an ejection port;

an electrode terminal formed at an end of a wiring extending from the printing element for transmitting electric energy to the printing element; and a lead for transmitting a driving signal for driving the printing element, the lead being arranged in a position corresponding to the electrode terminal; and a bump connecting between the electrode terminal and the lead, wherein the connection between the electrode terminal and the bump is performed by applying ultrasonic oscillation to a connecting part between the electrode terminal and the bump so that a main oscillation direction is a first direction while the electrode terminal is in contact with the bump, and the connection between the lead and the bump is performed by applying ultrasonic oscillation to a connecting part between the lead and the bump so that the main oscillation direction is a second direction intersecting with the first direction while the lead is in contact with the bump.

2. The printing head according to claim 1, wherein the bump receives the ultrasonic oscillation and is formed to have a predetermined shape, and the ultrasonic oscillation is applied to form the bump to have the predetermined shape so that the main oscillation direction is a third direction intersecting with the first direction and the second direction.

3. A method of manufacturing a printing head, comprising:

a preparing step of preparing a substrate including a printing element for applying energy to liquid in order to eject the liquid through an ejection port, an electrode terminal formed at an end of a wiring extending from the printing element for transmitting electric energy to the printing element, an electrical wiring substrate including a lead for transmitting a driving signal for driving the printing element, and a bump connecting between the electrode terminal and the lead, a step of connecting between the electrode terminal and the bump by applying ultrasonic oscillation to the bump so that a main oscillation direction is a first direction in a condition that the bump is in contact with the electrode terminal; and a step of connecting between the bump and the lead by applying ultrasonic oscillation to the lead so that a main oscillation direction is a second direction different from the first direction in a condition that the lead is in contact with the bump.

4. The method of manufacturing a printing head according to claim 3, wherein the method includes a bump formation step after the step of connecting between the electrode terminal and the bump, the bump formation step applies ultrasonic oscillation to the bump connected to the electrode terminal in a third direction intersecting with the first direction and the second direction to form the bump to have a predetermined shape, and the bump formed to have the predetermined shape is connected to the lead in the step of connecting between the lead and the bump.

5. The method of manufacturing a printing head according to claim 3, wherein the bump is connected to the electrode terminal while the electrode terminal is formed in a wafer, and connecting parts between all of plural electrode terminals in the wafer and plural bumps receive ultrasonic oscillation in the first direction.

* * * * *